US005884444A

United States Patent [19]

Harris

[11] Patent Number: 5,884,444

[45] Date of Patent: Mar. 23, 1999

[54] PANELING METHOD AND CONSTRUCTION

[76] Inventor: Craig H. Harris, 7325 Kings Walk La., Sylvania, Ohio 43560

[21] Appl. No.: 826,869

[22] Filed: Apr. 11, 1997

[51] Int. Cl.[6] ..... E04C 2/28; E06B 3/74; E06B 2/02; E04F 13/00

[52] U.S. Cl. ..... 52/311.2; 52/313; 52/314; 52/316; 52/506.01; 52/455; 52/456; 52/746.12; 52/747.1

[58] Field of Search ..... 52/506.01, 506.05, 52/313, 316, 314, 311.2, 455, 456, 311.1, 746.12, 747.1, 656.1, 656.4; 144/346

[56] References Cited

U.S. PATENT DOCUMENTS

| | | | |
|---|---|---|---|
| 1,430,996 | 10/1922 | Horlin | 52/455 X |
| 2,931,435 | 4/1960 | Neisewander | 52/455 X |
| 3,308,592 | 3/1967 | Miller | 52/455 |
| 3,731,444 | 5/1973 | Tobin | 52/455 X |
| 4,008,551 | 2/1977 | MacDonald et al. | 52/316 |
| 4,060,437 | 11/1977 | Strout . | |
| 4,083,160 | 4/1978 | MacDonald et al. | 52/316 |
| 4,097,100 | 6/1978 | Sauder . | |
| 4,327,788 | 5/1982 | Turner . | |
| 4,557,096 | 12/1985 | Hovde | 52/313 X |
| 4,706,431 | 11/1987 | Corvese . | |
| 4,736,559 | 4/1988 | Young | 52/313 |
| 5,003,745 | 4/1991 | Fang . | |
| 5,095,675 | 3/1992 | Audia | 52/455 |
| 5,355,654 | 10/1994 | Stanley . | |
| 5,540,026 | 7/1996 | Gartland . | |

*Primary Examiner*—Robert Canfield
*Attorney, Agent, or Firm*—Brinks Hofer Gilson & Lione

[57] ABSTRACT

A raised wall panel which includes a frame, a raised panel and a molding positioned between the two. The frame, having four frame members, is arranged in a "picture frame" configuration and attached to plywood fixed to a wall structure. The frame members are constructed of a base material, such as composition board or inexpensive plywood, which is covered by a decorative wood veneer. The raised panel is positioned within the frame using a spacing tool to ensure that the open area between the frame and the raised panel is uniform and the raised panel is attached to the plywood. The raised panel is also constructed of a base material which is covered by a decorative wood veneer. The molding has a built-up frame portion having a frame lip and a built-up panel portion having a panel lip. The molding is then positioned between the frame and the panel section such that the frame lip overlaps the frame member and the panel lip overlaps panel section. The frame lip and the panel lip cover the cut edges of both the frame and the raised panel, respectively, thus giving the appearance that the raised wall panel was formed from a piece of solid wood.

23 Claims, 1 Drawing Sheet

PANELING METHOD AND CONSTRUCTION

FIELD OF THE INVENTION

This invention relates to raised paneling for walls; more specifically, to the use of a molding in conjunction with a frame and panel section made of a base material covered with wood veneer so that the molding covers the cut edges of the base material/veneer combination, thus giving the appearance of a raised wall panel formed from a solid piece of wood.

BACKGROUND

Decorative moldings have been applied to surfaces of various types of composite slabs such as wall panels, doors and the like. The purpose of the molding is to enhance the appearance of the slab such that when finished in either its natural finish or painted, a rich panel effect is created. Such a panel effect attempts to simulate the overall effect created by master woodworkers of old who would carve solid slabs of wood to create individual raised panels of stunning beauty. Of course, such woodcarving today is unheard of for a variety of reasons. For example, the cost of solid slabs of wood would be enormous and the time it would take to carve them by hand would be unreasonably long. Hence, modem building contractors have looked to substitute the solid slab construction with something more cost effective and timely.

In order to achieve the rich look of hand carved panels while maintaining a cost effective pricing structure, a variety of different combinations of base materials with veneers have been used. There are a number of varieties of base material sheets which are available at retail lumber yards and wholesale distributors which are covered with a variety of decorative wood veneers. For example, one common base material is composition board or particle board made of wood chips and/or other materials glued together to form a single sheet. Another common base material would be a single sheet of cheap plywood such as pine. The base material/veneer combinations are significantly less costly than solid sheets of quality wood such as walnut or oak, provide the same structural properties, and have the rich, opulent appearance of solid quality wood on the outer surface.

The problem with using sheets of base material with wood veneer is that cut edges are visible on the finished product. Visible cut edges reveal the true nature of the sheet, i.e., the base material/veneer combination, and the illusion of solid, quality wood panels is ruined. It is therefore necessary to devise a raised wood panel which is made from the base material/veneer combination but still gives the appearance of being constructed from a solid piece of quality wood.

SUMMARY

To overcome the above-mentioned problem, a method of construction and device are provided which utilize cost effective base material/veneer combinations which are then used in conjunction with a strategically designed molding to hide the exposed or cut edges of the base material and veneer.

The preferred embodiment of the present invention includes a frame, a raised panel, and a molding fitted between the two. The frame typically has four frame members which are arranged in a "picture frame" configuration. The frame members are constructed from a base material such as composition board or particle board which are covered with a decorative wood veneer. The raised panel is usually square or rectangular in shape and is also made from a sheet of composition board covered by a sheet of decorative veneer. The molding includes four molding members. The molding members are formed from a single piece of quality wood, unlike the frame and the raised panel. Each of the molding members has a built-up frame portion at one end and a built-up panel portion at the other end. The two built-up portions of the molding define a valley into which may decorative pattern may be cut. The frame portion of the molding has a frame lip and the panel portion of the molding has a panel lip. It is the frame lip and the panel lip which overlaps the cut edges of the base material/veneer combination of the frame and raised panel. With the cut edges hidden, the appearance of a solid wood raised wall panel is created.

It is therefore an object of the present invention to provide a cost effective raised wall panel which gives the appearance of being formed from a solid piece of wood.

It is further an object of the present invention to provide a molding having built-up portions which overlap any cut or exposed edges of the base material/veneer combination of the raised wall panel.

Additional advantages and features of the present invention will become apparent from reading the detailed description of the preferred embodiments which make reference to the following set of drawings.

DETAILED DESCRIPTION

Figure 2:
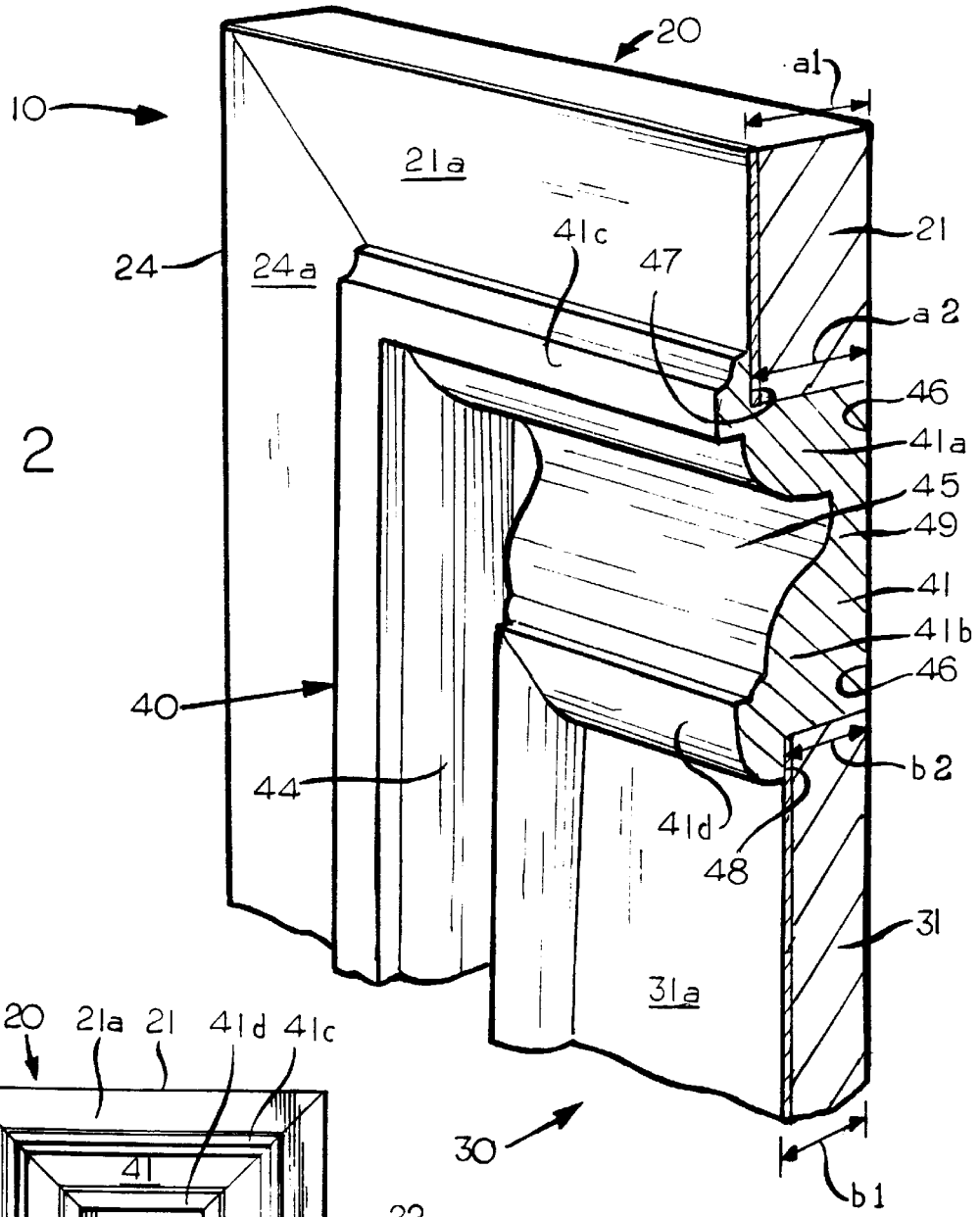
FIG. 2 shows a partial perspective cut away view of the raised wall panel shown in FIG. 1.
Figure 1:
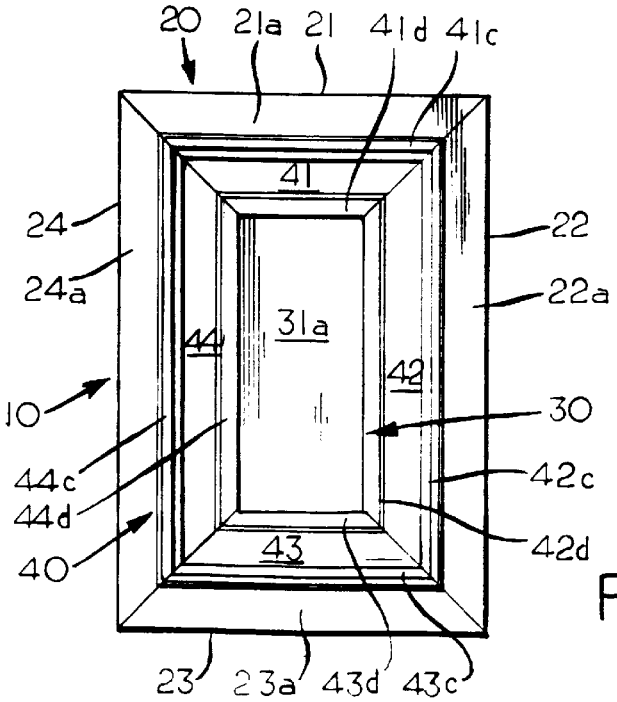
FIG. 1 shows a front elevational view of the preferred embodiment of the present invention.

Referring now to FIGS. 1 and 2, a raised wall panel is provided which is generally referred to by the reference numeral 10. The raised wall panel 10 includes a frame 20, a raised panel 30, and a molding 40.

The frame 20 includes four frame members 21–24 which are constructed of a base material which are cut and assembled into a typical "picture frame" configuration. The base material used in the preferred embodiment of the present invention is composition board, but may be any other material which provides the structural support required at a cost effective price, such as a sheet of pine plywood. The frame 20 is mounted to plywood, not shown, which is fixed directly to a wall structure, not shown (when constructing a raised panel wall, plywood is used instead of the standard drywall normally used in wall construction), with nails, screws, or an equivalent mounting means. The thickness of the frame members 21–24 of the frame 20 may vary from raised panel to raised panel but usually is one of a few standard sizes such as ½ inch, ¾ inch, etc. The frame members 21–24 are covered by a decorative wood veneer 21*a*–24*a*. The combined thickness of each frame member 21–24 and the veneer 21*a*–24*a* is equal to the distance a1 as shown in FIG. 2.

The raised panel 30 of the present invention includes a panel section 31 made of a sheet of base material, as previously described herein, appropriately cut and mounted to the aforementioned plywood (not shown), also using nails, screws, or equivalent mounting means. The thickness of the panel section 31 of the raised panel 30 may also vary, but again, is usually one of a few standard sizes. The panel section 31 is also covered with a decorative wood veneer

31*a*. The combined thickness of the panel section 31 and the veneer 31*a* is equal to the distance b1 as shown in FIG. 2.

The molding 40 is constructed of solid wood and includes four molding members 41–44. The molding member 41 includes a built-up frame portion or lobe 41*a* and a built-up panel portion, or lobe 41*b*, best shown in FIG. 2, which are connected by a narrow middle portion 49. Similarly, the molding members 42–44 have similar built-up frame portions (not shown) and panel portions (not shown) connected in a similar manner. The two built-up portions 41*a* and 41*b* of frame member 41 define a valley 45 in the molding member 41. Similar valleys (not shown) are defined by the built-up portions (not shown) of molding members 42–44. The frame portion 41*a* of the molding member 41 has a frame lip 41*c* and the panel portion 41*b* of the molding member 41 has a panel lip 41*d*. Similarly, the molding members 42–44 have frame lips 42*c*, 43*c*, and 44*c*, respectively, and also have panel lips 42*d*, 43*d*, and 44*d*, respectively. The distance between the inside edge 46 of the molding 40 (that is, the edge that would be closest to the wall) and the inside edge 47 of the frame lip 41*c*, is denoted by the reference numeral a2. Similarly, the distance between the inside edge 46 of the molding 40 and the inside edge 48 of the panel lip 41*d* is denoted by the reference numeral b2. The cross sectional design of the molding 40 is not important to the function of the present invention and may be any decorative pattern desired.

The assembly process is as follows. The frame 20 is attached to the plywood (not shown) of the wall (not shown) using nails, screws, glue or the like. The raised panel 30 is positioned within the frame 20 using a spacing device to ensure proper placement and then attached to the plywood (not shown). The molding 40 is then fitted into place between the frame 20 and the raised panel 30 and attached, usually with both glue and nails. The molding 40 is chosen such that the molding dimension a2 is equal to the total thickness a1 of the frame 20 and so that the molding dimension b2 is equal to the total thickness b1 of the raised panel 30. It is not necessary that the frame 20 and the raised panel 30 have the same thickness; for a richer appearance, the raised panel 30 may be thicker than the frame 20 (in other words, b1 may be greater than a1 and b2 may be greater than a2). With the molding 40 installed, the cut edges (not shown) of both the frame 20 and the raised panel 30 are covered, giving the raised wall panel 10 the appearance that it had been fashioned from a single piece of solid, high quality wood. The aforementioned process is then repeated until the desired surface area of the wall is covered.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed:

1. A raised wall panel comprising:

a rectangular frame adopted to be mounted to a wall structure, said frame comprising a base member comprised of a first material having an exposed inside edge and a first veneer comprised of a second material having an exposed inside edge;

a center panel positioned within said frame whereby forming a uniform space between said frame and said center panel, said center panel comprising a sheet of said first material having an exposed inside edge and a second veneer comprised of said second material having an exposed inside edge; and, a molding positioned within said uniform space between said frame and said center panel, said molding comprised entirely of said second material, said molding comprising a first lobe, a second lobe, and narrow middle section connecting said first lobe to said second lobe, said first lobe having a frame lip extending therefrom for overlapping both said exposed inside edge of said base member and said exposed inside edge of said first veneer, said second lobe having a panel lip extending therefrom for overlapping both said exposed inside edge of said sheet of first material and said exposed inside edge of said second veneer, whereby giving said raised wall panel the appearance of being formed from a single piece of said second material.

2. The raised wall panel according to claim 1 wherein the thickness of said center panel is less than or equal to the thickness of said frame.

3. The raised wall panel according to claim 1 wherein said molding further comprises a decorative pattern formed therein.

4. The raised wall panel according to claim 1 wherein said first material comprises particle board.

5. A method of constructing a wall surface having raised panels comprising the steps of:

a) attaching a frame to a wall, said frame comprising a plurality of frame members covered by a first veneer;

b) attaching a panel section to said wall, said panel section being positioned within said frame, said panel section being covered by a second veneer; and, c) attaching a molding between said frame and said panel section, said molding comprising a frame portion having a frame lip, a panel portion having a panel lip, said frame lip overlapping said frame and said panel lip overlapping said panel section.

6. The method according to claim 5 wherein said frame members and said first veneer further comprise exposed inside edges.

7. The method according to claim 6 wherein said panel section and said second veneer further comprise exposed inside edges.

8. The method according to claim 7 wherein said molding covers said exposed inside edges of both said panel section and said second veneer.

9. The method according to claim 6 wherein said molding covers said exposed inside edges of both said frame and said first veneer.

10. A raised wall panel comprising:

a frame comprising a plurality of frame members, said frame members comprised of a first base material covered by a first veneer;

a panel section comprising a sheet of a second base material covered by a second veneer, said panel section being disposed within said frame; and, a molding being positioned between said frame and said panel section whereby said molding overlaps said frame and said panel section.

11. The raised wall panel according to claim 10 wherein said first base material and said second base material are comprised of like materials.

12. The raised wall panel according to claim 10 wherein said first veneer and said second veneer are comprised of like materials.

13. The raised wall panel according to claim 10 wherein each frame members further comprises an inside edge and said first veneer further comprises an inside edge.

14. The raised wall panel according to claim 13 wherein said panel section further comprises an inside edge and said second veneer further comprises an inside edge.

15. The raised wall panel according to claim 14 wherein said molding comprises a plurality of molding members, each molding member having a first built-up portion and a second built-up portion, said first built-up portion and said second built-up portion being connected and defining a valley therebetween.

16. The raised wall panel according to claim 15 wherein said first built-up portion of each molding member further comprises a longitudinal lip extending therefrom and overlapping said inside edges of each frame member and said first veneer.

17. The raised wall panel according to claim 16 wherein said second built-up portion of each molding member further comprises a longitudinal lip extending therefrom and overlapping said inside edges of said panel section and said second veneer.

18. A raised wall panel, comprising:

a frame comprising a plurality of frame members, each frame member made of a first base material and a first decorative material covering a top surface of said base material;

a panel including a panel section made of a second base material and a second decorative material covering a top surface of said second base material; and, a molding interposed between said frame and said panel, said molding comprising a plurality of molding members, each molding member including a frame portion, a panel portion, and a middle portion interposed between said frame portion and said panel portion, said frame portion including a frame lip extending over at least a portion of said first decorative material of said frame, said panel portion including a panel lip extending over at least a portion of said second decorative material of said panel.

19. The raised wall panel according to claim 18 wherein said first base material and said second base material comprise plywood.

20. The raised wall panel according to claim 18 wherein said first base material and said second base material comprise particle board.

21. The raised wall panel according to claim 18 wherein said first decorative material and said second decorative material comprise wood veneer.

22. The raised wall panel according to claim 18 wherein a thickness of said middle portion of each molding member is less than a thickness of said frame portion and said panel portion of each molding member whereby forming a valley therebetween.

23. The raised wall panel according to claim 18 wherein a thickness of said frame is greater than a thickness of said panel.

* * * * *